US007658571B2

(12) United States Patent
McFarland

(10) Patent No.: US 7,658,571 B2
(45) Date of Patent: Feb. 9, 2010

(54) BARRELING WAVE GENERATING APPARATUS AND METHOD

(75) Inventor: Bruce C. McFarland, Solana Beach, CA (US)

(73) Assignee: American Wave Machines, Inc., Solana Beach, CA (US)

( * ) Notice: Subject to any disclaimer, the term of this patent is extended or adjusted under 35 U.S.C. 154(b) by 314 days.

(21) Appl. No.: 11/550,239

(22) Filed: Oct. 17, 2006

(65) Prior Publication Data

US 2008/0089744 A1 Apr. 17, 2008

(51) Int. Cl.
*E02B 3/00* (2006.01)

(52) U.S. Cl. ..... 405/79; 472/128

(58) Field of Classification Search ..... 405/79; 472/128

See application file for complete search history.

(56) References Cited

U.S. PATENT DOCUMENTS

| | | | |
|---|---|---|---|
| 3,350,724 | A | 11/1967 | Leigh |
| 3,557,559 | A | 1/1971 | Barr |
| 3,611,727 | A | 10/1971 | Blandford |
| 3,802,697 | A | 4/1974 | Le Mehaute |
| 3,851,476 | A | 12/1974 | Edwards |
| 3,913,332 | A | 10/1975 | Forsman |
| 4,522,535 | A | 6/1985 | Bastenhof |
| 4,564,190 | A | 1/1986 | Frenzl |
| 4,792,260 | A | 12/1988 | Sauerbier |
| 4,806,048 | A | 2/1989 | Ito |
| 4,954,014 | A | 9/1990 | Sauerbier et al. |
| 5,236,280 | A | 8/1993 | Lochtefeld |
| RE34,407 | E | 10/1993 | Frenzl |
| 5,271,692 | A | 12/1993 | Lochtefeld |
| 5,342,145 | A | 8/1994 | Cohen |
| 5,387,159 | A | 2/1995 | Hilgert et al. |
| 5,401,117 | A | 3/1995 | Lochtefeld |
| 5,421,782 | A | 6/1995 | Lochtefeld |
| 5,540,406 | A | 7/1996 | Occhipinti |
| 5,564,859 | A | 10/1996 | Lochtefeld |
| 5,664,910 | A | 9/1997 | Lochtefeld |
| 5,860,766 | A | 1/1999 | Lochtefeld |
| 5,899,634 | A | 5/1999 | Lochtefeld |
| 5,913,636 | A | 6/1999 | Macaulay |

(Continued)

OTHER PUBLICATIONS http://upload.wikimedia.org/wikipedia/commons/thumb/a/a1/F-117_Nighthawk_Front.jpg.*

(Continued)

*Primary Examiner*—David J Bagnell
*Assistant Examiner*—Sean D Andrish
(74) *Attorney, Agent, or Firm*—Manuel F. de la Cerra

(57) ABSTRACT

A wave forming apparatus has a channel for containing a flow of water, the channel having an inlet end connected to a water supply for supplying a flowing stream of water, a base, and spaced side walls, and at least one oblique foil member in the channel. The oblique foil member has a leading face extending at an oblique angle to the water stream in the channel, and a trailing, venturi face with a leading portion facing one of the side walls to form a venturi or constricted pass between the side wall and leading portion of the venturi face. The leading face, venturi face, and venturi pass together are adapted to form a standing barreling wave at the venturi pass.

37 Claims, 8 Drawing Sheets

U.S. PATENT DOCUMENTS

| | | | |
|---|---|---|---|
| 6,019,547 | A | 2/2000 | Hill |
| 6,105,527 | A | 8/2000 | Lochtefeld |
| 6,132,317 | A | 10/2000 | Lochtefeld |
| 6,336,771 | B1 | 1/2002 | Hill |
| 6,491,589 | B1 | 12/2002 | Lochtefeld |
| 6,629,803 | B1 | 10/2003 | McFarland |
| 6,726,403 | B1 | 4/2004 | Kriticos |
| 6,738,992 | B2 | 5/2004 | Lochtefeld |
| 6,928,670 | B2 | 8/2005 | Lochtefeld et al. |
| 6,932,541 | B2 | 8/2005 | McFarland |
| 2005/0286976 | A1 | 12/2005 | Lochtefeld et al. |
| 2006/0026746 | A1 | 2/2006 | McFarland |

OTHER PUBLICATIONS http://en.wikipedia.org/wiki/Hydraulic_jump.*

* cited by examiner

BARRELING WAVE GENERATING APPARATUS AND METHOD

BACKGROUND

1. Field of the Invention

The present invention relates generally to a wave forming apparatus and is partially concerned with water rides or water features of the type provided in water-based amusement parks, water features in ornamental gardens, and the like, and is particularly concerned with an apparatus for forming a barreling wave, also known as a tubing or tunneling wave, which can support surfing activities or produce an attractive visual effect in a fountain or the like.

2. Related Art

Naturally occurring waves occur in the ocean and also in rivers. These waves are of various types, such as moving waves which may be of various shapes, including tubular and other breaking waves. Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. This type of apparatus is described, for example, in U.S. Pat. Nos. 5,564,859 and 6,132,317 of Lochtefeld. In some cases, the inclined surface is shaped to cause a tubular form wave, such as in U.S. Pat. No. 4,792,260 of Sauerbier. Sheet flow wave simulating devices have some disadvantages. For example, since these systems create a fast moving, thin sheet of water, they produce a different surfing experience to a real standing wave.

In other prior art wave forming devices, a wave is actually simulated in the water itself, rather than being defined by a surface over which a thin sheet of water flows. U.S. Pat. No. 6,019,547 of Hill describes a wave forming apparatus which attempts to simulate natural antidune formations in order to create waves. A water-shaping airfoil is disposed within a flume containing a flow of water, and a wave-forming ramp is positioned downstream of the airfoil structure. Apparatus for forming deep water standing waves is described in my prior U.S. Pat. Nos. 6,629,803 and 6,932,541. This apparatus creates waves that simulate natural standing waves. Use of an oblique bed form extending across the width of the channel or two intersecting water flows to create a barreling wave is described in these patents.

SUMMARY

A wave forming apparatus has a channel for containing a flow of water, the channel having an inlet end connected to a water supply for supplying a flowing stream of water to the channel, a base, and spaced side walls, and at least one oblique foil member in the channel facing one of the side walls to form a venturi or constricted pass or throat between the side wall and foil, the oblique foil member having a leading, substantially flat face extending at an oblique angle to the water stream in the channel and tilted rearwardly relative to the water stream, and a trailing, venturi face opposing the channel side wall to form the venturi pass.

The combination of the oblique foil shape and opposing channel side wall together form a standing barrel wave which is like a river wave formed at a narrows. The part of the water stream which flows into the leading face of the oblique foil tends to rise up the tilted face and bend laterally towards the venturi pass. The part of the water stream which moves towards and up the venturi face and into the venturi pass combines with the deflected water from the leading face of the oblique foil, the two streams of water together forming a barreling wave in front of the venturi face and extending laterally into the venturi pass. After pitching out and forming the barrel, the water lands primarily in the venturi pass area on top of the primary stream of water through the pass.

In one embodiment, the top edge or peak of the oblique foil member is convex, and the foil may have a downwardly inclined trailing face, so that water flows freely over the peak of the foil member and back down to continue its flow along the channel. The venturi face of the foil member may curve back away from the opposing channel wall after the venturi pass. The height of the channel side walls is less than the height of the oblique foil in one embodiment, and below the peak of any wave formed in the venturi pass. This allows water to drain away from the venturi area Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an apparatus and method for forming waves in a water ride or water feature. For example, one method as disclosed herein allows for formation of a barreling or tubing wave which turns back at the peak to form a tube or tunnel.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
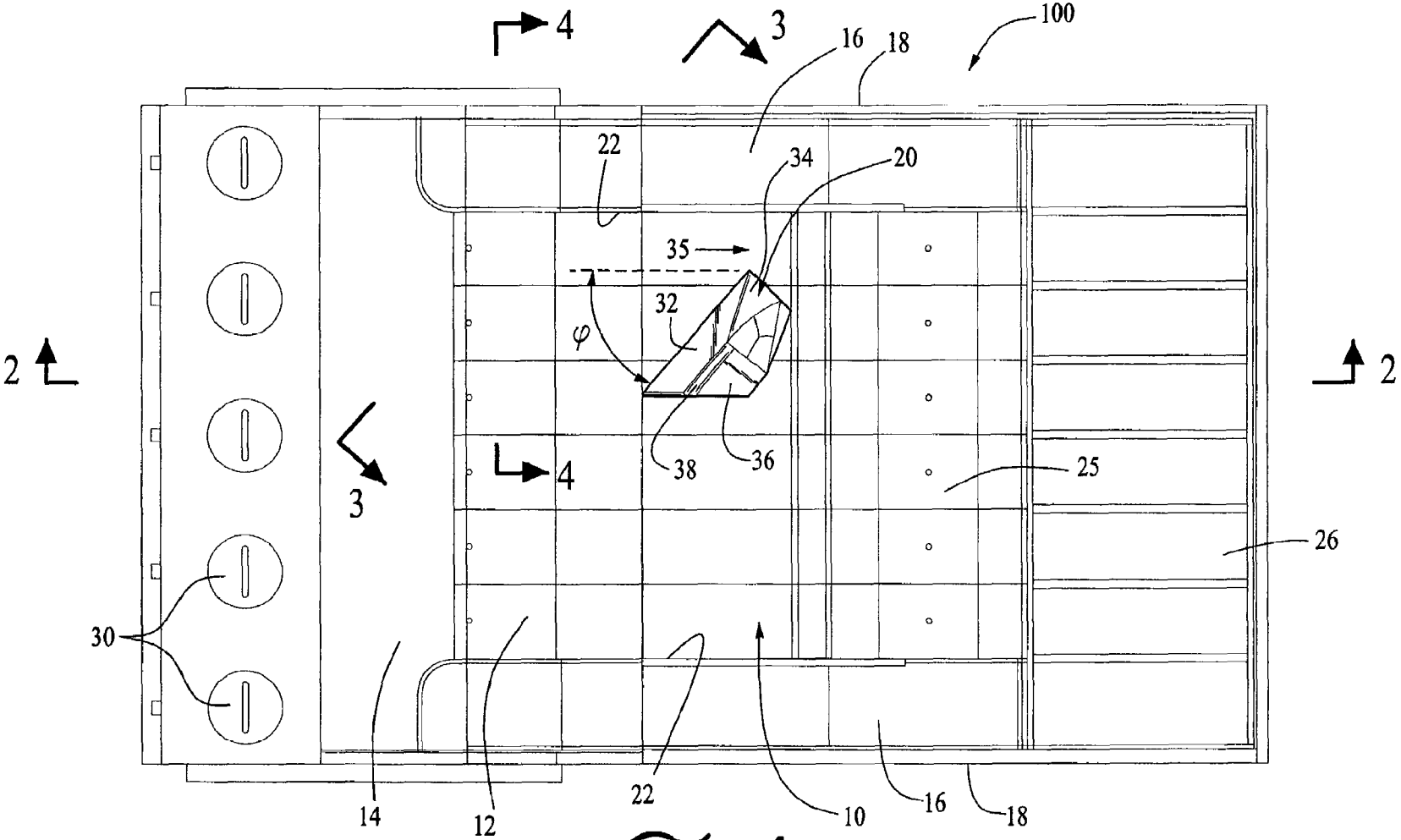
FIG. 1 is a top plan view of a wave forming apparatus of a first embodiment having a barreling wave forming foil.
Figure 2:
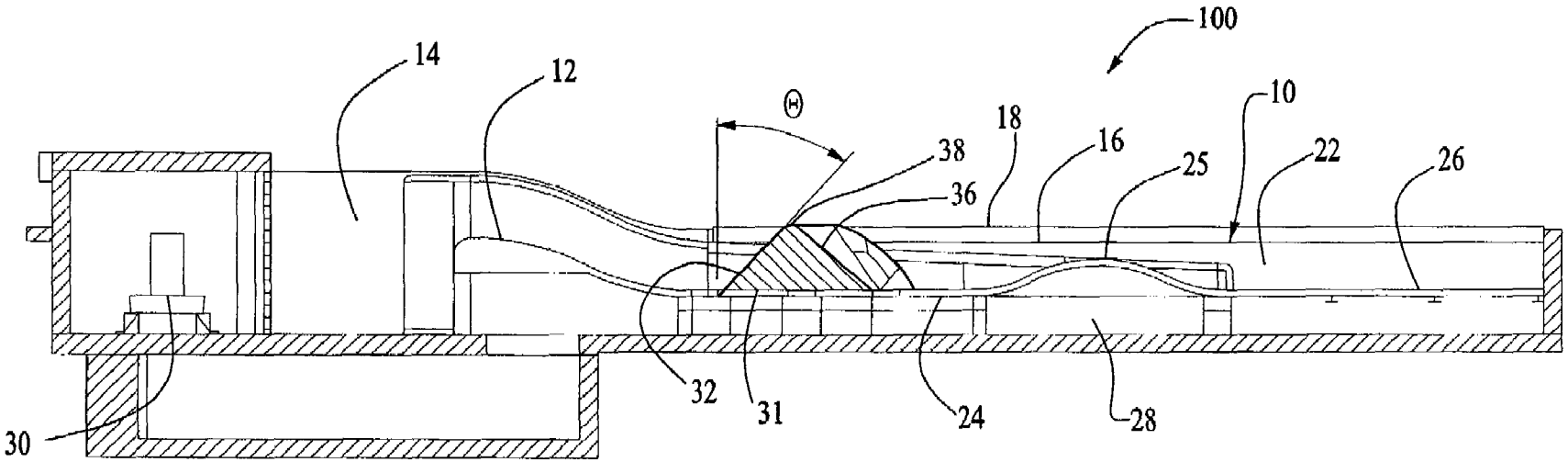
FIG. 2 is a cross-sectional view on the lines 2-2 of FIG. 1.
Figure 3:
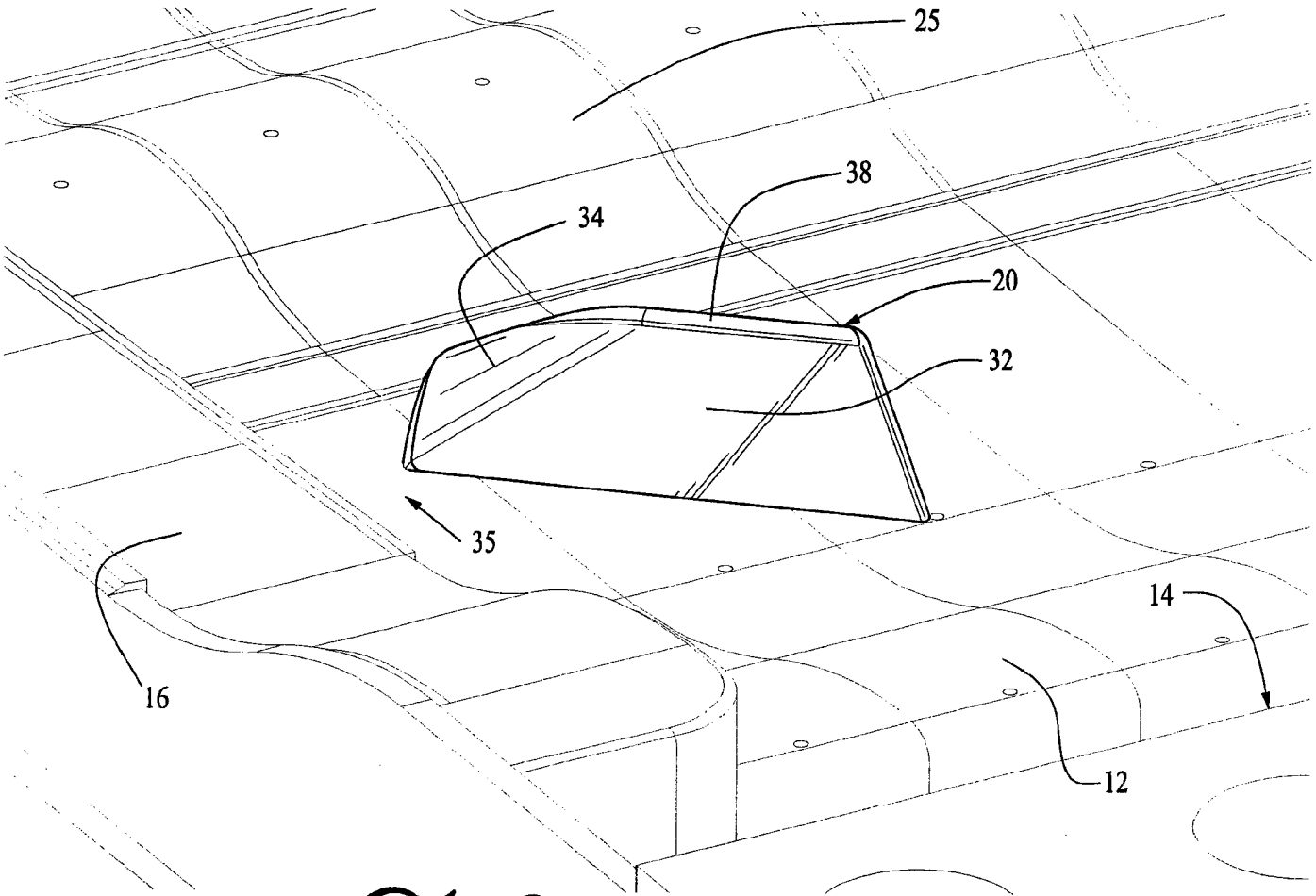
FIG. 3 is a perspective view of the wave forming foil in the direction of arrows 3-3 of FIG. 1.

FIGS. 1 to 4 illustrate a first embodiment of a wave forming apparatus 100 designed to form barreling waves. The apparatus basically comprises a channel 10 for containing a flow of water, the channel having a weir 12 at its inlet end connected to a supply of water in a reservoir 14. Reservoir 14 has a smooth radius throat section guiding water over weir 12 and into the channel 10. River banks or entry/exit portions 16 extend outwardly from opposite side walls 22 of the wave forming channel 10 to the outer sides 18 of the apparatus, which are spaced outwardly from the outer sides of channel 10, as best illustrated in FIGS. 1 and 3. The outer side walls 18 may be eliminated in alternative embodiments. The river banks may be inclined downwardly at a small angle towards the trailing or exit end of the channel. A barreling wave forming foil 20 is mounted in the channel facing one side wall 22 of the channel at an oblique angle to the flow direction of water along the channel. Apart from foil 20, the wave forming apparatus is similar to the apparatus described in my U.S. Pat. Nos. 6,629,803 and 6,932,541 and pending application Ser. No. 11/248,380 filed Oct. 11, 2005, and the contents of each of these documents are incorporated herein by reference.

As best illustrated in FIG. 2, the channel 10 has a base or lower wall 24 and the weir or alpha foil 12 is formed in the base wall at the inlet end of the channel so as to direct water from reservoir 14 into a flowing stream of relatively deep water along channel 10, as described in my prior patents and application referenced above. One or more bed forms or beta foils 25 for forming a standing wave may be located downstream of alpha foil 12 and oblique foil 20, but this is not essential and no additional foils may be provided downstream of oblique or barreling wave forming foil 20 in other embodiments. A grating 26 or the like is provided at the outlet end of the channel in this embodiment, and water is returned via a passageway 28 extending under floor 24 and pumped by pumps 30 back into the reservoir 14. In an alternative embodiment, water could be returned by running out of the channel into a river or pool.

Although a weir or alpha foil is used in the illustrated embodiments to direct a stream of water along channel 10, in alternative embodiments the desired stream condition could be created with a tank and sluice gate or nozzle. The opposite side walls 22 of the channel may be straight, as illustrated, or may taper outwardly from the inlet end to the outlet end of the channel, and define a primary flow path for water through the channel.

Weir or alpha foil 12 curves downwardly from its peak to the base 24 of the channel. The oblique or barreling wave forming foil 20 may be formed in the base of the channel or may be a modular component for securing in the base of the channel as desired. It may be built flush in the flat tail portion extending from the alpha foil 12 and raised by means of actuators into the position shown in the drawings, or may be an inflatable device that can be raised and lowered. This allows the channel to be used to produce only a standing wave at beta foil 25, as described in my prior patents and pending application referenced above, or to be used to produce standing barreling waves by raising the oblique foil 20.

Oblique foil 20 has a base 31 for mounting in the base 24 of the channel, a generally flat or slightly convex, inclined leading face 32, a venturi face 34 extending from the leading face 32 and forming a venturi pass 35 with the adjacent side wall 22 of the channel, and a rear face 36. In the illustrated embodiment, the leading face 32 is at a sweep angle $\Phi$ of around 40 degrees to the direction of oncoming water flow in the channel, as best seen in FIG. 1. Angle $\Phi$ may be in the range from 10 degrees to 70 degrees in alternative embodiments. Leading face 32 is also inclined at a vertical tilt or pitch angle $\Theta$, as seen in FIG. 2. In the illustrated embodiment, angle $\Theta$ is 35 degrees from vertical, but may be in the range from 25 to 70 degrees in alternative embodiments. The upper edge 38 of the foil is convex or curved to reduce the risk of injury. The foil height in the illustrated embodiment is about equal to the height of the outer side walls 18 and greater than the height of channel side walls 22. This height difference is to ensure that at least part of a wave forming in the venturi pass is above the height of the channel walls, so that water can drain away from the venturi area and along the river banks 16 to avoid choking or backing up the flow. In one embodiment, the height of the channel wall 22 is around eleven inches below the peak 38 of the foil, and the channel wall height is around 30 inches. These dimensions are suitable for a 2.5 foot wave, but may be scaled up or down in alternative embodiments, depending on the overall size of the wave forming apparatus. The trailing or rear face 36 is also generally flat and inclined downwardly.

Figure 4:
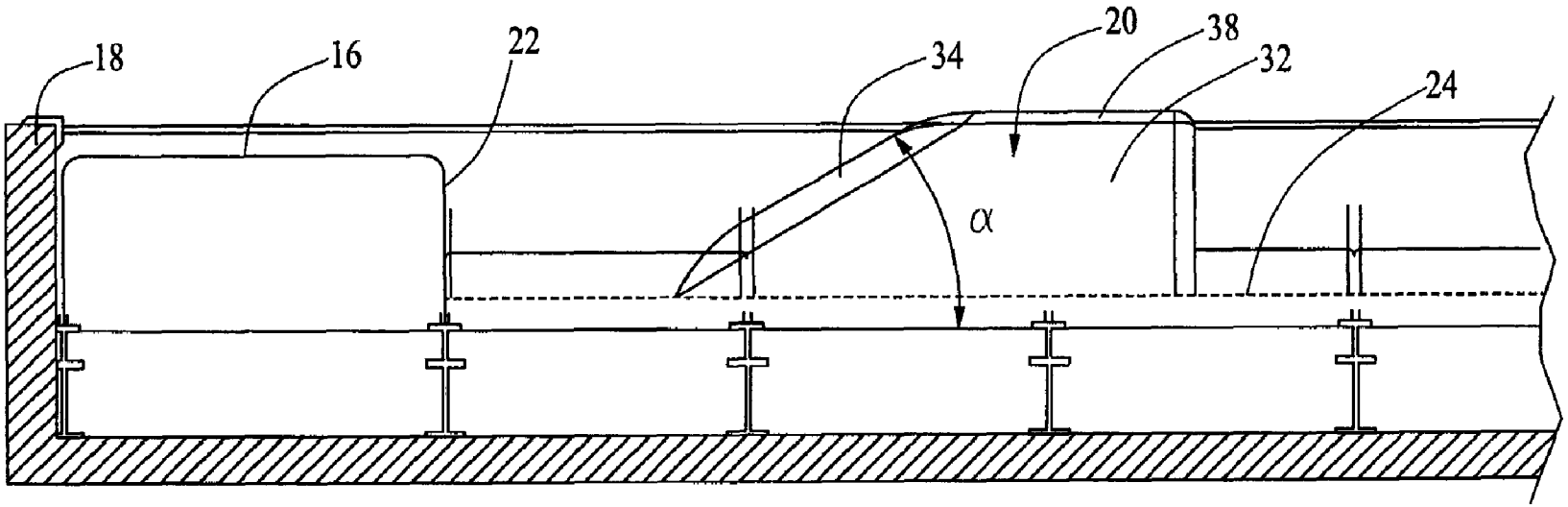
FIG. 4 is a front elevation view of the foil in the channel in the direction of arrows 4-4 of FIG. 1.

The venturi face 34 starts off facing the opposing channel side wall 22 and has a convex curvature leading from the trailing end of the relatively flat leading face 32, then curves rearwardly back towards trailing or rear face 36 and downwardly towards the base of the channel, as best illustrated in FIG. 3. The curved apex 37 of the venturi face is rounded for safety to avoid a sharp corner, and also helps to reduce turbulence in the water flowing around the apex. The venturi pass 35 is defined between the leading, convex end of venturi face 34 and the opposing channel side wall. The leading end of face 34 is inclined away from the channel side wall at a "yaw" angle $\alpha$ so that the venturi pass increases in width in a direction upwardly from the base of the channel, as best illustrated in FIG. 4. In the illustrated embodiment, yaw angle $\alpha$ is around 31 degrees, but this angle may range from 90 degrees to 20 degrees in alternative embodiments, dependent on the desired width of the venturi pass.

In this apparatus, an initial smooth and streamlined flow of relatively deep water enters the channel at foil 12. In one embodiment, the water velocity at the inlet end of the channel is around 12 feet per second while the water depth is around 0.7 feet. In alternative embodiments, the velocity may be in the range of around 8 to 25 fps, and the water depth may be in the range from 0.5 to 3.5 feet. Part of the water in the left hand half of the channel as viewed in FIG. 3 rises up the leading face 32 and bends laterally towards the venturi pass 35. The water moving over the leading face is of sufficient depth and velocity to support surfing maneuvers on various types of surfing equipment such as surfboards, bodyboards, and small kayaks known as playboats. At the same time, water moving towards the venturi face 34 of foil 20 combines with deflected water from leading face 32 to create a standing barreling wave in front of the venturi face extending laterally into the venturi pass 35. Riders can therefore ride in the barrel wave on a surfboard or bodyboard, where the apparatus is used as a water park attraction or ride. Alternatively, the apparatus on a smaller scale can be used for a visual or ornamental water feature (like a fountain) in parks, gardens, and other locations. The opposing channel wall 22 contains some of the water and allows some to spill onto the river bank 16 and run downstream to the grating or drain.

The stream or flow rate of water arriving at the venturi pass is related to the size of the barreling wave formed at the pass. The faster the incoming rate, the bigger the wave. The venturi pass 35 and venturi face 34 are shaped to impede the flow of water so that the barrel is supported by deeper water through the pass. If the pass is too constricted, the barrel wave drowns and collapses. If the pass is not restricted enough, the barrel is smaller or non-existent, although there is still a surfable wave face in front of the foil 20. The venturi face is positioned close enough to the channel side wall 22 for the water flow to be impeded sufficiently to form a standing barreling wave. In the illustrated embodiment, the width of the venturi pass at the base of the channel is of the order of 37 inches and the overall channel width is around 20 feet. The venturi pass width is varied depending on the size of the channel and foil and the water stream rate characteristics. In general, the venturi pass width is approximately the same as the height of foil 20, and the maximum height of the foil is approximately the same as the desired wave height.

On arriving at the venturi pass 35, the water transitions from its initial shallower, higher speed condition ahead of leading edge of venturi face 34 to a substantially deeper stream above the venturi face and into the venturi pass. After pitching out and forming the barrel, the water lands primarily in the venturi pass area on top of the primary stream. This is a safety advantage, since riders can land in water. The primary stream serves to force the low energy water continuously through the venturi pass and over beta foil 25.

As noted above, the peak or top of the oblique foil 20 is convex, and the peak and inclined downstream or rear face 36 of the foil allow water to stream freely over the foil in this area. The foil peak and downstream foil trailing surface 36 together allow a relatively smooth and safe transition for riders down into the downstream portion of the channel. Although the leading face of the foil has an abrupt or angled intersection with the floor 31 of the channel, as seen in FIG. 2, it may alternatively be smoothly blended into the floor for a smooth, curved transition from floor to foil.

The river banks 16 allow drainage around the foil 20 without allowing water to leave the outer containment walls, and also allow for entry and exit of the ride. The channel may alternatively be made wider and deeper, but this is not practical for entry and might require more water flow and expense to operate.

In the embodiment of FIGS. 1 to 4, the barreling wave forming foil and venturi pass take up half or less than half of the width of the channel. Another type of wave may be formed in the other half of the channel, such as a wave of the type formed by shaped bed forms in the channel, as described in my prior patents and application referenced above. Alternatively, a second barreling wave forming foil may be mounted in the other half of the channel, as described below in connection with FIGS. 5 and 6.

Figure 5:
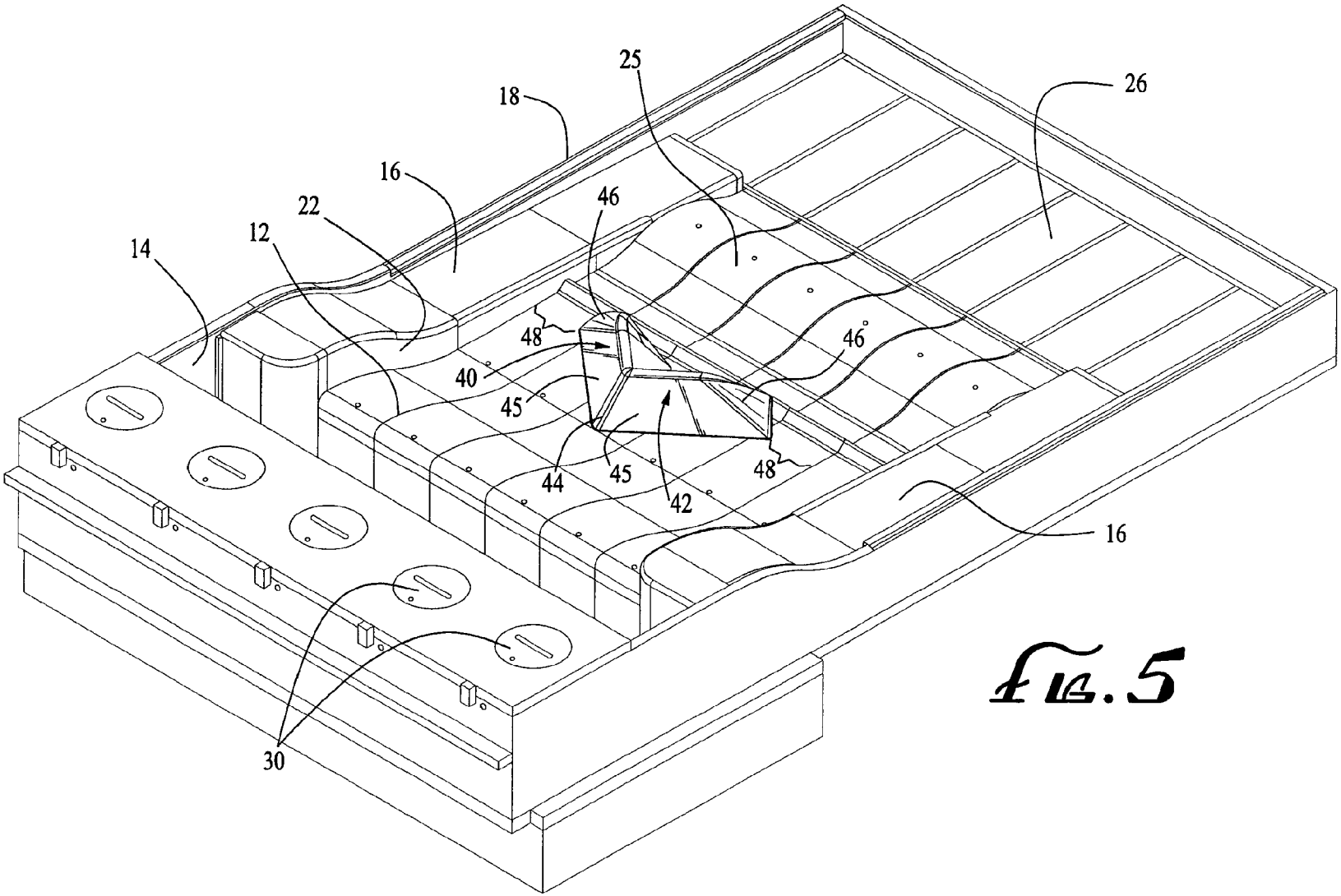
FIG. 5 is a perspective view of a wave forming apparatus of another embodiment having a double barreling wave forming foil for forming two barrel or tubing waves.

FIG. 5 illustrates a modified embodiment where the single oblique foil 20 of FIGS. 1 to 4 is replaced with two oblique foils 40,42 in a V-shaped arrangement, with the apex 44 of the V facing upstream and located approximately at the center of the channel. The apparatus in this embodiment is otherwise the same as the previous embodiment, and like reference numbers have been used for like parts as appropriate. In this embodiment, two barreling waves are formed on opposite sides of the channel, as described in more detail below.

Oblique foils 40,42 may be formed integrally as indicated in FIG. 5, or may be formed separately and then suitably attached together at their apex. As in the previous embodiment, each foil has an oblique, generally flat, inclined leading face 45 and a rearwardly curved venturi face 46 defining a venturi pass 48 between the leading edge of face 46 and the opposing side wall 22 of the channel. The shape and dimensions of each foil is substantially the same as that of the foil 20 of FIGS. 1 to 4, except that the second foil 42 is a mirror image of the first. In this apparatus, two standing barreling waves are formed, one in each venturi pass, allowing two riders to ride the waves simultaneously.

Figure 6:
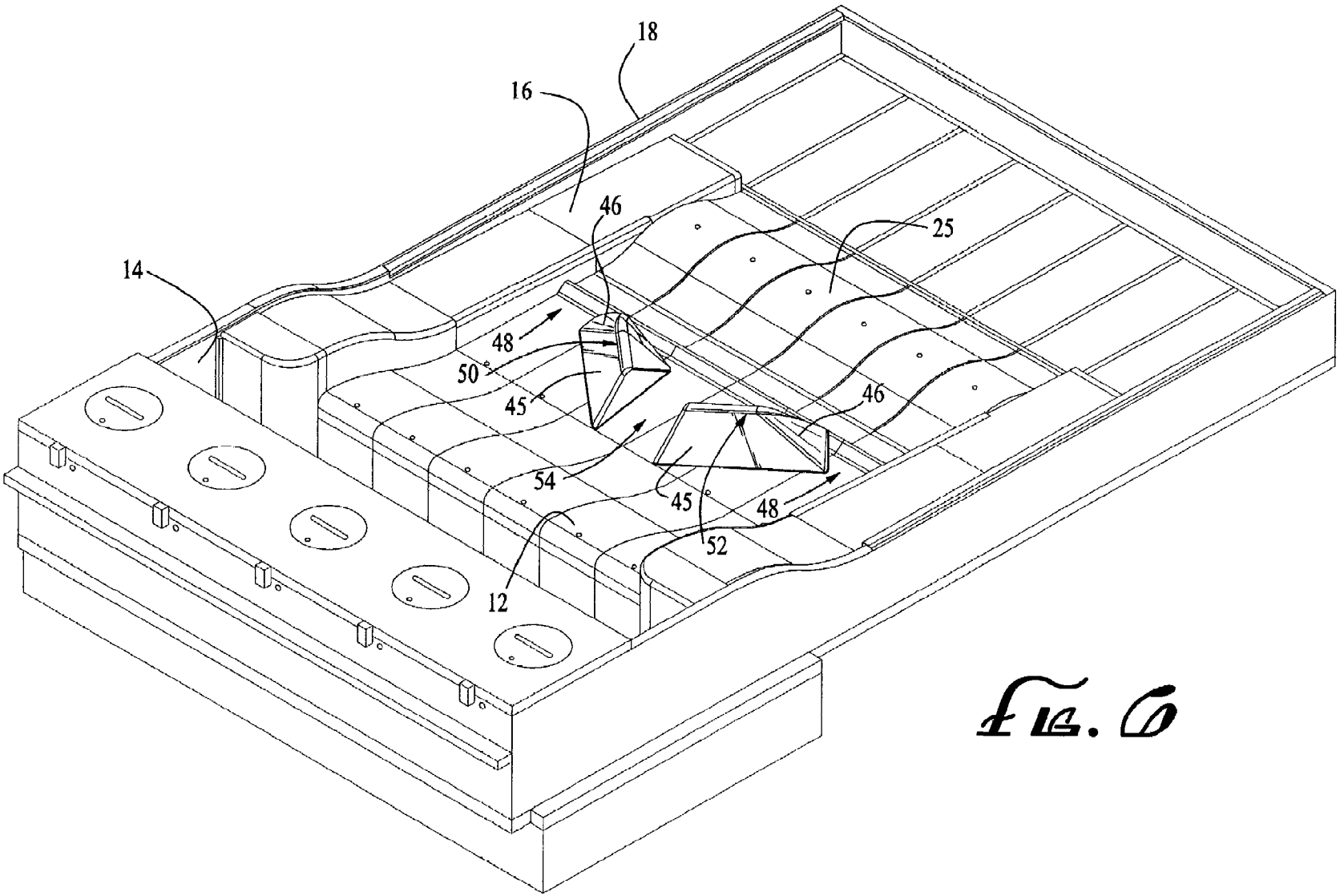
FIG. 6 is a perspective view similar to FIG. 5 illustrating another embodiment in which two separate barreling wave forming foils are mounted in the channel.

FIG. 6 illustrates another embodiment which is similar to that of FIG. 5 in that two barreling wave forming foils 50,52 are used, but the foils in this case are separate, with a pass 54 formed along the center of the channel 10 between the foils. This apparatus is otherwise identical to that of the previous embodiments, and like reference numbers have been used for like parts as appropriate. As in FIG. 5, each foil 50,52 has a generally flat, inclined leading face 45 and a rearwardly curved venturi face 46 leading from the trailing end of the leading face and defining a venturi pass 48 between the leading edge of face 46 and the opposing channel side wall 22.

In each of the above embodiments, the barreling wave forming foils can be formed integrally in the base of the channel or may be separate modules having bases adapted for mounting in the channel as desired. They may be built flush in the base of the channel and raised into position by actuators when a barreling wave action is desired. Alternatively, they may be inflatable devices that can be inflated or deflated as desired by a ride operator.

In the embodiment of FIG. 6, as in the previous embodiment, two separate standing barreling waves are formed, one at each venturi pass 48. The pass 54 between the foils in FIG. 6 improves stream conditions downstream and behind the foils 50,52 and also helps to separate riders if necessary.

Figure 7:
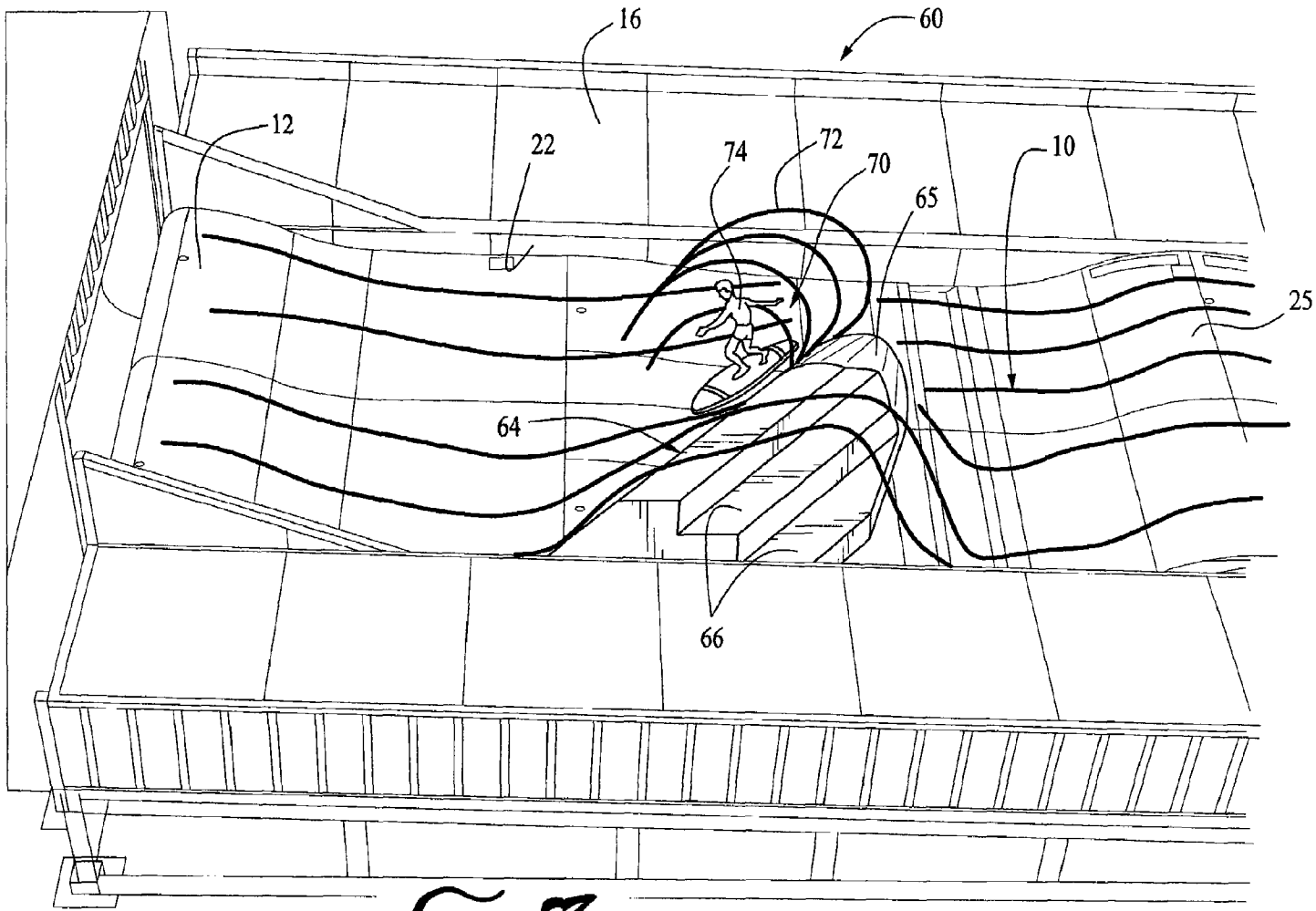
FIG. 7 is a perspective view of a wave forming apparatus similar to FIG. 1 but with a modified barreling wave forming foil, schematically illustrating the formation of a barreling wave and a rider riding in the wave.
Figure 8:
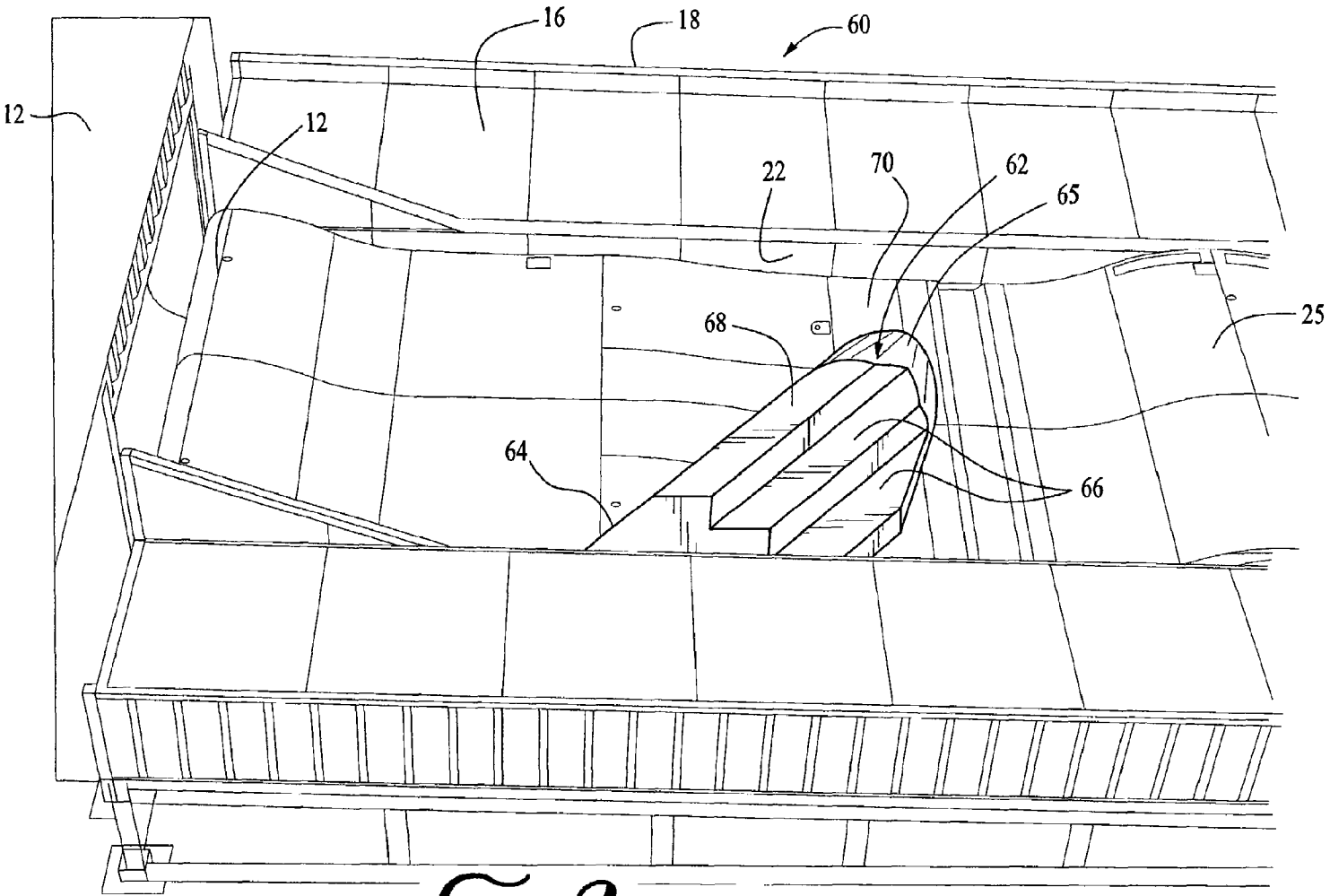
FIG. 8 is a perspective view similar to FIG. 7 but without any water or waves shown in the channel.

FIGS. 7 and 8 illustrate a wave forming apparatus 60 of another embodiment which has an oblique or barreling wave generating foil 62 which extends across a larger portion of the channel 10 than in the previous embodiments. In this embodiment, a single barreling wave generating foil and venturi gap span the entire width of the channel, rather than only around half of the channel as in the previous embodiments, and the shape of the rear wall of the channel is modified. The remainder of the apparatus in FIGS. 7 and 8 is the same as in the previous embodiments, and like reference numerals have been used for like parts as appropriate. This embodiment is more appropriate for a dedicated barreling wave machine, whereas the previous embodiments are appropriate for a channel in which a barreling wave is one of several water attractions or rideable waves.

As in the previous embodiments, foil 62 is mounted in the base 24 of the channel downstream of alpha foil or weir 12. Foil 62 extends from one side wall 22 across the channel at an oblique angle to the water flow direction. Foil 62 has a generally flat, inclined leading face 64 and venturi face 65 extending from the leading face, as in the previous embodiments. However, the trailing or rear face of the foil is modified. The trailing face is formed with a series of steps 66 leading up to the peak 68 of foil 62. These steps can be used as a possible entry point for the ride.

The shapes and angles of the leading and venturi faces 64,65 in this embodiment are the same as in the previous embodiments, with the leading face 64 inclined both to the flow direction and the base of the channel. The venturi face is convex and the leading edge or portion forms a venturi pass 70 with the adjacent, opposing side wall 22 of the channel. Venturi face 65 then curves back away from the side wall, as in the previous embodiments.

FIG. 7 schematically illustrates the water flow through channel 10, as indicated by the darker lines. As can be seen, water flowing on the right hand side of the channel as viewed from alpha foil 12 flows up and over the leading face 64 of the foil. Water moving towards the venturi face 65 of foil 62 in the left hand part of the channel combines with deflected water from leading face 64 to create a standing barreling wave 72 in front of the venturi face extending laterally into the venturi pass 70. FIG. 7 illustrates surfer 74 riding in the wave. The opposing channel wall 22 contains some of the water and allows some to spill onto the river bank 16 and run downstream to the grating or drain. Water will also spill off the leading face of the foil onto the other river bank 16. Alternatively, the channel wall on this side could be raised to prevent spilling, or the foil could be extended widthwise over the inner channel side wall and onto the river bank to prevent water spilling on this side.

The apparatus illustrated in each of the above embodiments may be scaled up or down depending on the type of water attraction desired. At a smaller scale it is suitable for inner tubing rather than surfing, and at an even smaller scale it may be used for a visual, fountain-like water feature rather than a ride. Larger scales of the apparatus may be used for surfing sports parks and events.

The outer side walls 18 in any of the above embodiments could be eliminated so that water could flow off opposite sides of the apparatus, for example into an adjacent pool or river. In this case, the adjacent pool or river may be at or close to the same elevation as the river bank.

The standing barrel wave created by the above embodiments is like a river wave created at a narrows. The venturi gap simulates a narrows, with the shape of the leading face and venturi face of the barrel wave forming foil enhancing the formation of the standing wave. The tilting away of the leading end of the venturi face from the channel wall provides a bottom contour at which water piles up on top of the foil in a controlled way. The venturi pass dimensions together with the design of the venturi face impedes water flow and supports the barrel through the pass. The deflection of some of the water flow by the oblique angle and shape of the leading face of the foil creates streamlines with a lateral velocity component towards the venturi gap which collide with streamlines flowing substantially downstream into the venturi pass zone, creating a wave shaped face and a barreling section in the venturi pass. At the same time, excess water is allowed to spill out onto the adjacent river bank and run downstream.

The combination of the oblique foil shape and opposing channel side wall together form a standing barrel wave which is like a river wave formed at a narrows. The part of the water stream which flows into the leading face of the oblique foil tends to rise up the tilted face and bend laterally towards the venturi pass. The part of the water stream which moves towards and up the venturi face and into the venturi pass combines with the deflected water from the leading face of the oblique foil, the two streams of water together forming a barreling wave in front of the venturi face and extending laterally into the venturi pass. After pitching out and forming the barrel, the water lands primarily in the venturi pass area on top of the primary stream of water through the pass.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A wave forming apparatus, comprising:

a channel having an inlet end, a base, and opposite first and second side walls;

a water supply at the inlet end of the channel for supplying a flowing stream of water to the channel;

at least one raised foil member having a predetermined maximum height in the base of the channel, the foil member having a leading face extending towards the first side wall of the channel at an oblique angle to the flowing stream of the water, the leading face having a leading end and a trailing end in a flow direction, and a venturi face extending from the trailing end of the leading face, a leading portion of the venturi face facing the first side wall to define a venturi pass between the first side wall and the leading portion of the venturi face wherein a width of the venturi pass is approximately equal to the foil height, and a trailing portion of the venturi face extending away from the first side wall;

and the leading face, the venturi face, and the venturi pass together being adapted to form a standing barreling wave at the venturi pass.

2. The apparatus of claim 1, wherein the leading portion of the venturi face is of rounded, convex shape.

3. The apparatus of claim 1, wherein the trailing portion of the venturi face is rounded.

4. The apparatus of claim 1, wherein the leading portion of the venturi face is inclined away from the first side wall at a predetermined tilt angle.

5. The apparatus of claim 1, wherein the leading face is tilted in the flow direction at a predetermined vertical tilt angle to the base of the channel.

6. The apparatus of claim 1, further comprising first and second river banks extending along opposite sides of the channel, the first river bank extending outwardly from the first channel side wall and the second river bank extending outwardly from the second channel side wall.

7. The apparatus of claim 6, wherein the river banks are angled downwardly in a downstream direction from the inlet end of the channel.

8. The apparatus of claim 1, wherein the height of the first side wall is less than the height of the foil member.

9. The apparatus of claim 8, wherein the height of the first side wall is approximately eleven inches less than the height of the foil member.

10. The apparatus of claim 1, wherein the leading face of the foil member is inclined at a first tilt angle relative to the base of the channel and is inclined at a second, sweep angle relative to the water flow direction.

11. The apparatus of claim 10, wherein the tilt angle is in the range from 20 to 80 degrees from the vertical.

12. The apparatus of claim 10, wherein the sweep angle is in the range from 10 degrees to 70 degrees.

13. The apparatus of claim 10, wherein the tilt angle is approximately 31 degrees.

14. The apparatus of claim 10, wherein the tilt angle is in the range from 90 degrees to 20 degrees.

15. The apparatus of claim 1, wherein the leading face is substantially flat.

16. The apparatus of claim 1, wherein the leading face is convex.

17. The apparatus of claim 1, wherein the foil member has a peak at the top of the leading face and a downstream face extending from the peak to the base of the channel.

18. The apparatus of claim 17, wherein the peak is of a convex, rounded shape.

19. The apparatus of claim 17, wherein the downstream face is shaped to form steps.

20. The apparatus of claim 17, wherein the downstream face is shaped to form a ramp.

21. The apparatus of claim 1, wherein the first foil member is located in a first half of the channel and a second foil member is located in a second half of the channel adjacent with the first foil member, the second foil member having a second leading face extending at an oblique angle to the flowing stream of the water towards the second side wall, and a second venturi face extending from the trailing end of the second leading face, a leading portion of the second venturi face being rounded and facing the second side wall to define a second venturi pass between the second side wall and the leading portion of the second venturi face, a trailing portion of the second venturi face curving back away from the second side wall, and the second leading face and the second venturi face are adapted to form a second standing barreling wave at the second venturi pass.

22. The apparatus of claim 21, wherein the second foil member is a mirror image of the first foil member.

23. The apparatus of claim 21, wherein the first and second foil members are joined together at an apex to form a generally V-shape with the apex facing upstream.

24. The apparatus of claim 21, wherein the first and second foil members are positioned in transverse alignment at the same general location in the channel, and are spaced apart to form a gap between the foil members at a central location between the first and second side walls of the channel.

25. The apparatus of claim 1, wherein the foil member and the venturi pass span the width of the channel between the first and the second side walls.

26. The apparatus of claim 1, wherein the channel has a predetermined width and the foil member and the venturi pass span a width no greater than half the channel width.

27. The apparatus of claim 1, wherein the foil member is inflatable between a collapsed position in which no barreling waves are formed and an inflated condition in which the standing barreling wave is formed at the venturi pass.

28. The apparatus of claim 1, wherein the foil member is retractable into a retracted position beneath the base of the channel.

29. The apparatus of claim 1, further comprising a weir at the inlet end of the channel, the water supply having a supply outlet having a smooth radius throat section directing water over the weir.

30. A method of forming a standing barreling wave, comprising:

positioning a foil member to project upwardly from a base of a channel to a predetermined maximum height with a leading face of the foil member at an oblique angle to a water stream direction defined by the channel and a venturi face at a predetermined spacing from a first channel side wall approximately equal to the foil height to define a venturi pass between a leading portion of the venturi face and the channel side wall;

supplying a flowing stream of water to an inlet end of the channel towards the foil member;

deflecting part of the water stream arriving at the leading face of the foil member into a deflected stream directed towards the venturi pass; and combining the deflected stream of water with water flowing directly along the channel into the venturi pass;

whereby the standing barreling wave is formed at the venturi pass.

31. A foil device for forming a standing barreling wave, comprising:

an airfoil shaped member having a front face, a rear face, a peak, and a base adapted for mounting in a channel containing a flowing stream of water such that the front face extends at an oblique angle to a water stream direction;

the front face having a leading end and a trailing end;

a trailing, venturi face extending from the trailing end of the front face to the rear face of the member; and the venturi face having a leading portion adapted to face in a direction transverse to the water stream direction and towards a side wall of the channel, and to form a venturi pass with the side wall of the channel at a width that is approximately equal to the height of the airfoil peak to form the standing barreling wave when the airfoil shaped member is installed in the channel.

32. The device as claimed in claim 31, further comprising a second airfoil shaped member which is a mirror image of the first mentioned airfoil shaped member, the leading ends of the venturi faces of the two members being joined together to form a general V-shape, and the leading portions of the two venturi faces being adapted to face opposite side walls of the channel in which the device is installed to form a first venturi pass between one venturi face and one side wall of the channel and a second venturi pass between the other venturi face and the other side wall of the channel.

33. The device as claimed in claim 31, wherein steps are formed in the rear face of the member.

34. The device as claimed in claim 31, wherein the venturi face has a trailing portion which curves rearwardly away from the leading portion.

35. The device as claimed in claim 31, wherein the leading portion of the venturi face is inclined relative to the base of the member, and is adapted to incline away from an opposing channel side wall between the base and the peak of the member.

36. The device as claimed in claim 31, wherein the peak has a convex, rounded shape.

37. The device as claimed in claim 31, wherein the leading portion of the venturi face is of rounded, convex shape.

* * * * *